United States Patent [19]

Hübner

[11] 4,382,455

[45] May 10, 1983

[54] MULTIPLE PICK SYSTEM FOR A WEAVING MACHINE

[75] Inventor: Oskar Hübner, Constance, Fed. Rep. of Germany

[73] Assignee: Sulzer Brothers Limited, Winterthur, Switzerland

[21] Appl. No.: 212,421

[22] Filed: Dec. 3, 1980

[30] Foreign Application Priority Data

Dec. 27, 1979 [EP] European Pat. Off. ..... 79 105381.2

[51] Int. Cl.[3] ..... D03D 47/24

[52] U.S. Cl. ..... 139/439; 139/453

[58] Field of Search ..... 139/429, 437, 439, 450, 139/453

[56] References Cited

U.S. PATENT DOCUMENTS

| | | | |
|---|---|---|---|
| 2,817,367 | 12/1957 | Pfarrwaller | 139/453 |
| 3,276,482 | 10/1966 | Liebehen | 139/453 |
| 3,511,284 | 5/1970 | Tosches | 139/453 |
| 3,526,254 | 9/1970 | Schmitz | 139/453 |
| 3,554,240 | 1/1971 | Sakamoto | 139/453 |

FOREIGN PATENT DOCUMENTS

| | | | |
|---|---|---|---|
| 1009568 | 5/1957 | Fed. Rep. of Germany | 139/453 |

*Primary Examiner*—Henry Jaudon

*Attorney, Agent, or Firm*—Kenyon & Kenyon

[57] ABSTRACT

The multiple pick system uses a drive for each control element. Each drive includes a roller lever which is pivotally mounted and driven by a cam mounted on the continuously rotating shaft of the machine. A locking member is movable into the path of the roller lever so as to prevent the roller on the lever from contacting the cam. The locking member serves to take out of operation the control elements for the weft yarn type which is not to be inserted while allowing the remaining control elements to be driven. The multiple pick system is especially suitable for high speeds.

4 Claims, 8 Drawing Figures

MULTIPLE PICK SYSTEM FOR A WEAVING MACHINE

This invention relates to a multiple pick system for a weaving machine. More particularly, this invention relates to a multiple pick system for a weaving machine having a weft yarn supply disposed outside a shed of the weaving machine.

As is known, various types of multiple pick systems have been used for feeding weft yarns from a multiplicity of supply spools into a shed of warp yarns within a weaving macine. Generally, these systems include weft yarn feed means having at least two parallel yarn control elements, such as yarn brakes and/or yarn tensioners, and a weft yarn changer for receiving yarn from one or the other of the feed means. In such cases, the yarn control elements which are to feed the yarn are coupled to a drive before each weft insertion in accordance with a weft insertion program. For example, it has been known from Swiss Pat. No. 332,438 and U.S. Pat. No. 2,817,367 to provide a drive for the yarn tensioners and yarn brakes which is constructed of a sleeve mounted on a continuously rotating drive shaft in an axially displaceable manner. In addition, the sleeve has two cams which cooperate with two roller levers associated with the respective yarn tensioner and yarn brake. During operation, before each weft insertion, the cam sleeve is displaced so that the two cams are placed under the two roller levers of the yarn tensioner and yarn brake over which the desired weft yarn is to be inserted.

However, at relatively high speeds of the weaving machine, for example, 300 picks per minute and more, the cam sleeve presents difficulties. Specifically, due to the relatively great mass of the sleeve, a relatively high drive force is required for the axial displacement of the sleeve. Further, this drive force cannot be reliably provided, for example by a spring accumulator element lying in the drive of the weft changer, and the sleeve does not execute an axial displacement precisely enough and quickly enough.

Accordingly, it is an object of the invention to provide a multiple pick system for a weaving machine which can be rapidly changed over at high speeds of operation.

It is another object of the invention to provide a multiple pick system for a weaving machine which can be reliably operated at high speeds.

Briefly, the invention provides a multiple pick system for a weaving machine having a weft yarn supply remaining outside a shed. This system is comprised of a weft yarn feed means for feeding a plurality of yarns and includes at least two series of yarn control elements disposed in parallel relation for controlling two respective yarns and a weft yarn changer for receiving a yarn from a selected one of the control elements. In addition, the system has a plurality of drives for the control elements, each of which is coupled to a respective control element and includes a cam and a roller lever spring biased toward the cam in order to follow the cam. Further, the system has a locking member which is movable into the path of each roller lever to prevent the roller lever from following the respective cam. The roller levers of each series of control elements are also disposed to engage the locking element on opposite sides so as to load the locking member uniformly.

In this system, there is no need to push the same drive cams under the roller levers to be driven by an axial displacement of a cam sleeve. Instead, each roller lever has a respective drive cam.

The locking member serves to prevent the blocked roller lever from following a respective cam, for example by lifting the roller lever away from the cam into an inoperative position without requiring an axial displacement of the cam. Tests have shown that with this picking system, the respective yarn tensioner or yarn brake can be readily placed in operation for the next following pick even at high speeds of from 300 to 600 picks per minute and more. Further, the movements of the levers can be carried out exactly.

These and other objects and advantages of the invention will become more apparent from the following detailed description taken in conjunction with the accompanying drawings in which:

FIG. 7 illustrates a schematic view of a modified drive for a locking member of a multiple pick system in accordance with the invention; and FIG. 8 illustrates a cross sectional view of a modified locking member in accordance with the invention.

Figure 1:
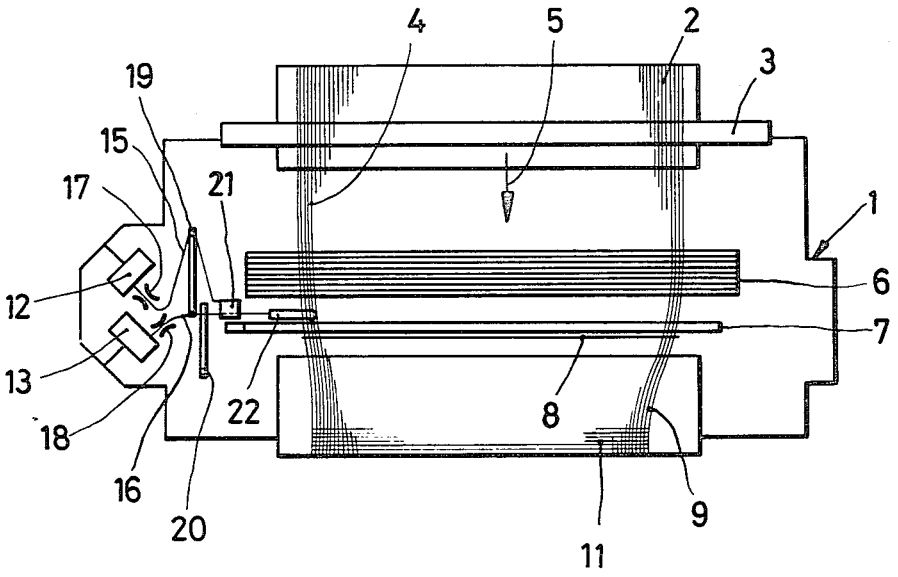
FIG. 1 illustrates a schematic plan view of a weaving machine having a multiple pick system according to the invention.

Referring to FIG. 1, a weaving machine 1 includes a warp beam 2, a tensioning beam 3 over which a multiplicity of warp yarns 4 supplied from the warp beam 2 run in the direction indicated by the arrow 6, heedles 6 which form a shed of the yarns 4, and a reed 7 for beating-up a weft yarn at a beat-up point 8 to form a fabric 9. The waving machine 1 also has a cloth beam 11 onto which the formed fabric 9 is guided and wound and a plurality of, for example two, weft yarn supply bobbins 12, 13 for feeding weft yarns 15, 16 of different types or colors into the shed formed within the weaving machine 1.

The weaving machine 1 is also provided with a multiple pick system for selectively feeding the yarns 15, 16 from the bobbins 12, 13 into the shed. The system includes a feed means which employs at least two parallel series of yarn control elements for controlling each respective yarn 15, 16. As indicated, each series of elements includes a yarn brake 17, 18 and a yarn tensioner 19, 20, respectively. The pick system also includes a weft yarn changer 21 for receiving a yarn from a selected one of the series of control elements 17, 19; 18, 20 for placement in a projectile 22 for picking into the shed.

Figure 2:
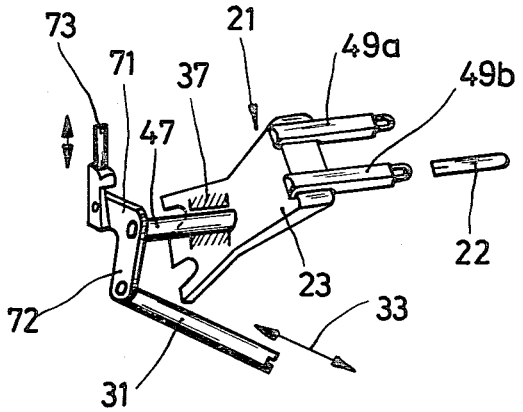
FIG. 2 illustrates a perspective view of the multiple pick system of FIG. 1.
Figure 3:
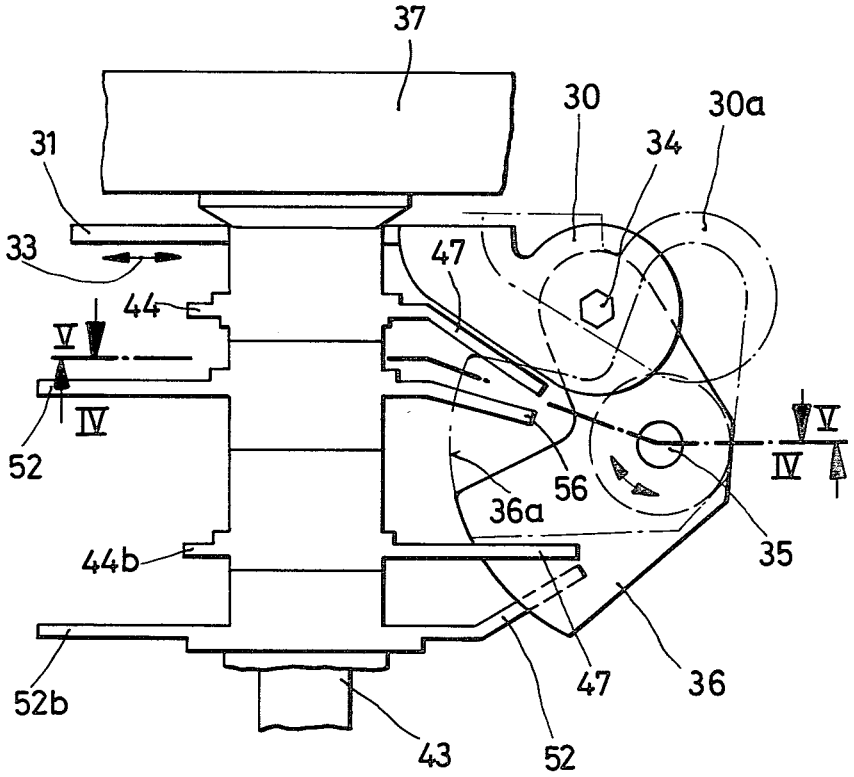
FIG. 3 illustrates a plan view of a number of drives of the multiple pick system in accordance with the invention.

Referring to FIG. 2, the weft yarn changer 21 has a changer segment 23 which is pivotable about a shaft 47 and which contains two yarn feeds **49*a*, 49*b* which serve to transfer the selected yarn 15, 16 to the projectile 22. The shaft 47 carries a two-armed lever 71, 72 which has one arm 71 connected to a drive rod 73** which is movable in an up and down manner in order to actuate the segment 23. The other arm 72 is connected to a control rod 31 which is displacable back and forth in the direction indicated by the arrow 33 when the segment 23 is moved into position via the arm 71. The control rod 31, in turn, carries a connecting piece 30 as shown in FIG. 3, which is articulated at a point 34 to a locking member in the form of a lock plate 36. The lock plate 36 is mounted on an axle 35 which is rotatably mounted in a frame 37 of the weaving machine (FIG. 4) so as to be pivotal.

Figure 4:
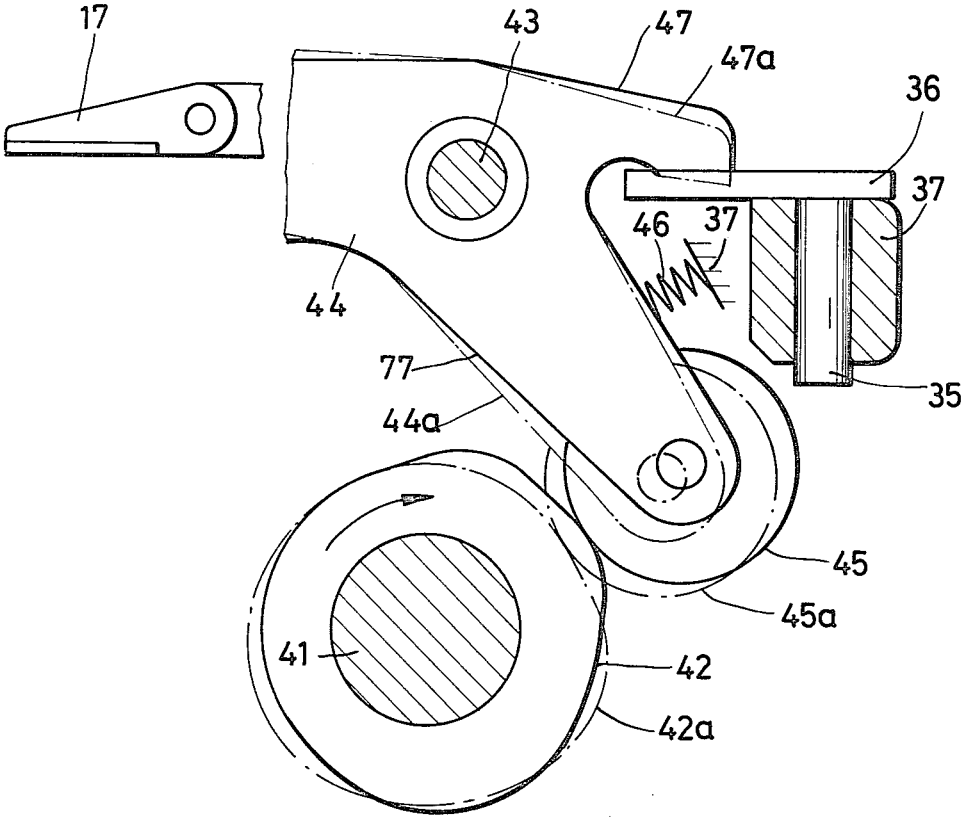
FIG. 4 illustrates a view taken on line IV—IV of FIG. 3.

Referring to FIG. 3, a plurality of drives are provided for the various control elements 17, 19 with each drive coupled to a respective control element 17, 19. As shown in FIG. 4, the drive for the yarn brake 17 includes a cam 42 which is mounted on a continuously rotating drive shaft 41 and a roller lever 44 which is pivotally mounted on a common shaft 43 and connected to the yarn brake 17. The roller lever 44 carries a roller 45 which is spring biased via a spring 46 toward the cam 42 in order to follow the cam 42. As shown, the spring 46 is abutted against the frame 37 of the machine 1. In addition, the roller 44 carries a projecting arm 47 while as indicated in FIG. 3, the lock plate 36 is pivotable about the axle 35 to move into the path of movement of the arm 47.

The yarn brake 18 is driven in a similar fashion by a drive which includes a cam (not shown) mounted on the shaft 41 and, a roller lever 44*b* (FIG. 3) mounted on the shaft 43 which carries a roller (not shown) and which is biased by a spring (not shown) towards the cam.

Figure 5:
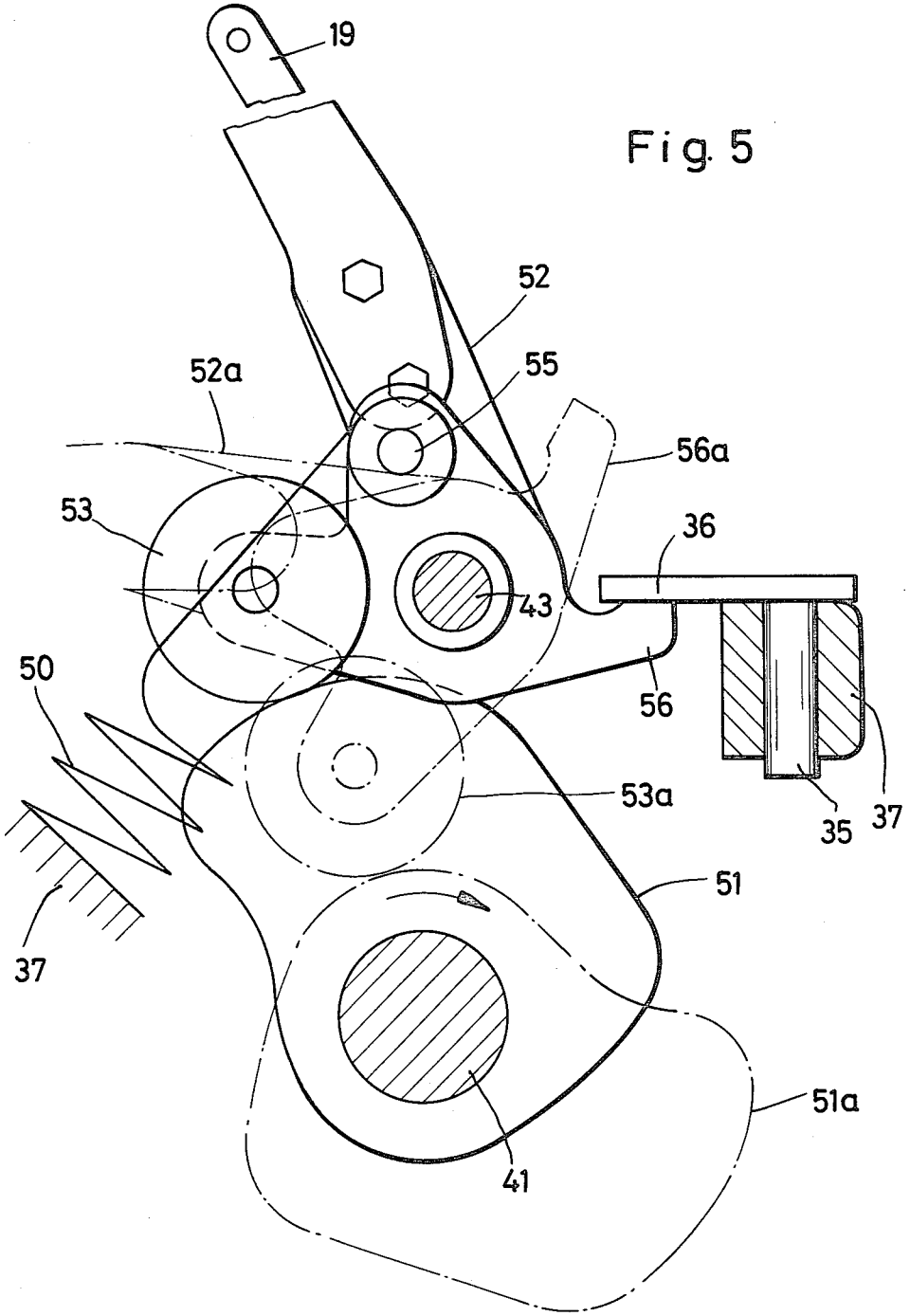
FIG. 5 illustrates a view taken on line V—V of FIG. 3.

Referring to FIG. 5, the drive for the yarn tensioner 19 includes a cam 51 which is mounted on the shaft 41 and a roller lever 52 which is pivotally mounted on a shaft 43 and connected to the yarn tensioner 19. The roller lever 52 carries a roller 53 and is biased by a spring 50 so as to move the roller 53 against the cam 51 to follow the cam 51. As indicated, the spring 50 abuts the frame 37 of the machine and engages the lever at 55. The roller lever 52 also has an arm 56 which is able to pivot into the path of the lock plate 36 from below as viewed.

In similar manner, the yarn tensioner 20 has a drive which includes a cam and a roller lever 52*b* (FIG. 3) which pivots about the shaft 43 and carries a roller wheel (not shown) which is biased against the cam by a spring (not shown).

As indicated in FIG. 3, the arms 47 of the roller levers 44, 44*b* are disposed above the lock plate 36 while the arms 56 of the roller levers 52, 52*b* are disposed below the lock plate 36. Thus, when in use, the lock plate 36 is positioned between the respective arms 47, so as to be loaded uniformly from both sides.

Referring to FIG. 3, during operation, if before a weft insertion, the lock plate 36 is in the position in solid lines, the roller lever 44 is pivoted into the position 44*a* (FIG. 4) as the cam 42 is moved from the position shown in solid line in FIG. 4 into the position 42*a* shown in dash-dot lines as the roller lever 44 follows the cam 42. At the same time, the roller 45 reaches the position 45*a* while the arm 47 reaches the position 47*a* shown in dash-dot lines. In a corresponding manner, the cam 51 (see FIG. 5) moves into the position 51*a*, the roller lever 52 follows the cam 51 into the position 52*a* as shown in dash-dot lines and roller 53 moves into the position 56*a* as shown in dash-dot lines. Thus, the yarn brake 17 which is coupled to the roller lever 44 and the yarn tensioner 19 which is coupled to the roller lever 52 are driven. The yarn brake 17 and tensioner 19 are thus actuated according to a program during the following weft insertions so that the yarn 15 can be picked into the shed. During this time, the yarn brake 18 and tensioner 20 are out of operation since the roller levers 44*b*, 52*b* are locked.

When the yarn changer segment 23 is moved, the lock plate 36 is moved into the position 36*a* as shown in dash-dot lines in FIG. 3. Thus, the arms 47, 56 of the roller levers 44, 52 are locked so that the arms 47, 56 of the roller levers 44*b*, 52*b* are released. The roller levers 44, 52 then remain in the position shown in solid lines in FIGS. 4 and 5 (i.e. locked) when the cams 42, 51 are turned into the positions 42*a*, 51*a* shown in dash-dot lines. The respective yarn brake 17 and yarn tensioner 19 are then out of operation during the following weft insertion as these elements are not being driven. On the other hand, the yarn brake 18 coupled to the roller lever 44*b* and the yarn tensioner 20 connected to the roller lever 52*b* are being driven so that the weft yarn 16 guided thereto can be picked.

Figure 6:
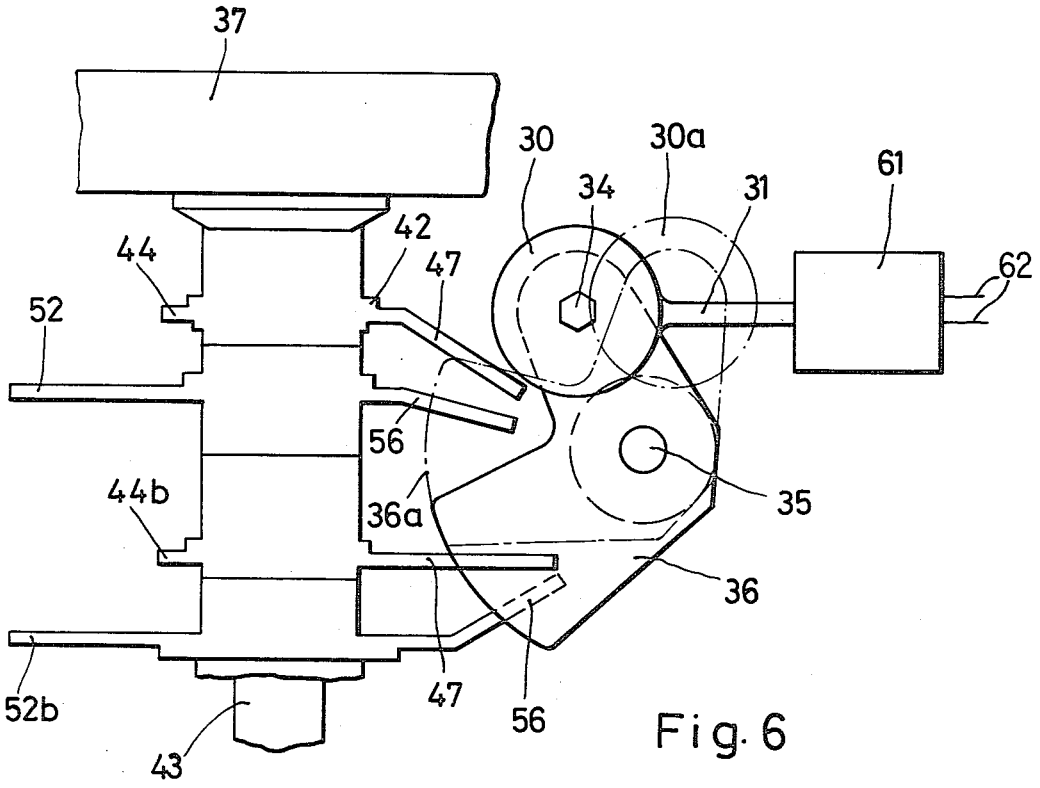
FIG. 6 illustrates a modified pick system in accordance with the invention.

Referring to FIG. 6, wherein like reference characters indicate like parts as above, the lock plate 36 can alternatively be reciprocated via an electromagnet 61 so as to be moved between the respective arms 47, 56 of each series of control elements 17, 19. In this case, the electromagnet 61 receives current pulses via electrical lead lines 62 or becomes currentless according to a suitable program depending upon the type of yarn desired for the next weft insertion.

The multiple pick system can be used for a changer with four or six different yarn types. In such cases, a correspoindingly shaped lock plate 36 and a corresponding number of roller levers for the four or six yarn brakes and yarn tensioners are provided.

The lock plate 36 can alternatively be driven by a pneumatic or hydraulic drive cylinder utilizing a pressure piston. For example, in a weaving machine having an air jet insertion, the lock plate 36 may be actuated with compressed air. In similar fashion, in a weaving machine using a water jet insertion, the lock plate 36 can be actuated via the pressure water.

The locking member for the various roller levers may be in the form of a reciprocating lock element which may be positioned at the edge of the roller lever 44. In this case, upon actuation, the element moves into the path of one or more of the levers 44 so as to prevent the lever from moving into the operating position 44*a*.

What is claimed is:

1. A multiple pick system for a weaving machine, said system comprising a weft yarn feed means for feeding a plurality of yarns, said feed means including at least two parallel series of yarn control elements for controlling a respective yarn, each series of yarn control elements including at least one pair of said elements;

a weft yarn changer for receiving a yarn from a selected one of said series of control elements;

a plurality of drives, each said drive having a movable cam and a roller lever connected to a respective control element and spring biased toward said cam to follow said cam for actuation of said respective control element; and a locking member movable into the path of each respective roller lever to prevent said respective roller lever for following said respective cam, said roller levers of a respective series of control elements being disposed to engage said locking element on opposite sides.

2. A cam system as set forth in claim 1 wherein said locking member is a pivotally mounted plate.

3. A system as set forth in claim 1 wherein said locking member is connected with said weft yarn changer for movement thereby.

4. A system as set forth in claim 1 which further comprises an electromagnet for controlling the movement of said locking member.

* * * * *